US007675011B2

(12) United States Patent
Jonson

(10) Patent No.: US 7,675,011 B2
(45) Date of Patent: Mar. 9, 2010

(54) MISSILE GUIDANCE SYSTEM

(75) Inventor: Henrik Jonson, Linköping (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 11/525,029

(22) Filed: Sep. 22, 2006

(65) Prior Publication Data

US 2010/0019078 A1 Jan. 28, 2010

(30) Foreign Application Priority Data

Sep. 23, 2005 (EP) ..... 05108819

(51) Int. Cl.
*F41G 7/00* (2006.01)
*F42B 15/01* (2006.01)
*F42B 15/00* (2006.01)

(52) U.S. Cl. ..... 244/3.15; 102/473; 102/475; 244/3.1; 89/1.11

(58) Field of Classification Search ..... 244/3.1–3.3; 89/1.11; 342/62; 102/200, 206, 211–214, 102/473, 475, 476
See application file for complete search history.

(56) References Cited

U.S. PATENT DOCUMENTS 4,245,560 A * 1/1981 Rambauske ..... 102/213
4,444,110 A * 4/1984 Lindner et al. ..... 102/213
4,494,437 A * 1/1985 von Maydell ..... 89/1.11
4,519,315 A 5/1985 Arszman et al.
4,589,610 A * 5/1986 Schmidt ..... 244/3.19
4,614,317 A * 9/1986 Stavis ..... 244/3.19
4,679,748 A * 7/1987 Blomqvist et al. ..... 244/3.19
4,848,236 A * 7/1989 Hembise ..... 102/213
5,455,587 A * 10/1995 Schneider ..... 342/62
5,755,400 A 5/1998 Kalms, III et al.
5,932,822 A 8/1999 Hammon et al.
5,932,833 A * 8/1999 Hammon et al. ..... 102/213
6,455,828 B1 9/2002 Gauggel et al.

FOREIGN PATENT DOCUMENTS

EP 0392086 A 10/1990
EP 0434474 A 6/1991
EP 0434474 A1 * 6/1991
FR 2669722 A 5/1992
WO WO 00/00779 A 1/2000

OTHER PUBLICATIONS

European Search Report.

* cited by examiner

*Primary Examiner*—Bernarr E Gregory
(74) *Attorney, Agent, or Firm*—Venable LLP; Eric J. Franklin

(57) ABSTRACT

A missile guidance system and method for guiding a missile, mainly horizontally flying, to pass a target at a desired passage height.

9 Claims, 4 Drawing Sheets

MISSILE GUIDANCE SYSTEM

The present invention refers to a method and a system for guiding a missile, and also to a missile provided with such a system. In particular, it refers to such guidance systems for missiles using passive target seeker, where the missile is devised not to hit the target dead on, but to pass by at a predetermined distance.

BACKGROUND

When using missile systems it is sometimes desirable to let the missile miss the target with a certain distance. One example comprises an antitank missile travelling approximately horizontally and provided with a shaped charge devised to hit at an angle downwards/forwards. Said missile should pass approximately one meter over the tank to enable the shaped charge to achieve good effect at the tank. It should be mentioned that most conventional tanks usually are well protected against direct hits from the front, side and behind. The missiles "NLAW" and "Bill" are examples of missiles using such a method, although they are not utilising target seeking mechanisms.

Another example concerns attacks using a ground target missile, where the target seeker is not able to see the target, but where it has been possible to determine the target position in relation to one or more other objects that can be seen by the target seeker.

Most known missile systems for antitank warfare use missiles that approach the target from above. There seems to be few if any known systems of today that combine the benefits of a target seeker, a horizontally flying missile having a shaped charge devised to hit downwards, with means for steering the missile in such a way that it passes a predetermined distance above the target.

U.S. Pat. No. 5,932,833 discloses a fly over homing guidance system for terminal homing missile guidance which comprises a fire and forget missile guidance method wherein on board target sensing tracks the target and guides the missile to the target, but instead of being guided to a direct impact as is conventionally done, the missile is guided towards a precise distance over the top of the target, intentionally avoiding impact.

The use of target seeking and inertial navigation system data in order to accomplish a direct hit is well known in the art. The use of the same information to accomplish that the missile "misses" the target with an appropriate distance is less known.

SUMMARY OF THE INVENTION

It is a purpose of the present invention to provide a missile guidance system for use in a missile, where said system is capable of guiding said missile to pass a predetermined distance above a target.

Said missile guidance system comprises a gamma-ref calculation unit capable of calculating a reference value of a vertical flight direction angle which, if used to adjust a current vertical flight direction angle $\gamma_{ref}$ of said missile, would cause the missile to pass the target at a desired passage height ($h_{des}$).

Said gamma-ref calculation unit calculates the reference value of the vertical flight direction angle ($\gamma_{ref}$) based on the following parameters:

an elevation angle ($\sigma$)

a desired passage height ($h_{des}$)

a line-of-sight rotation ($\dot{\sigma}$)

a missile velocity (V).

In a preferred embodiment said reference value is calculated as $$\gamma_{ref} = \sqrt{\frac{h_{des}\dot{\sigma}}{V}} - \sigma$$

BRIEF DESCRIPTION OF THE DRAWINGS

Preferred embodiments of the present invention is described with reference to the accompanying drawings, in which.

DETAILED DESCRIPTION OF PREFERRED EMBODIMENTS

Figure 1:
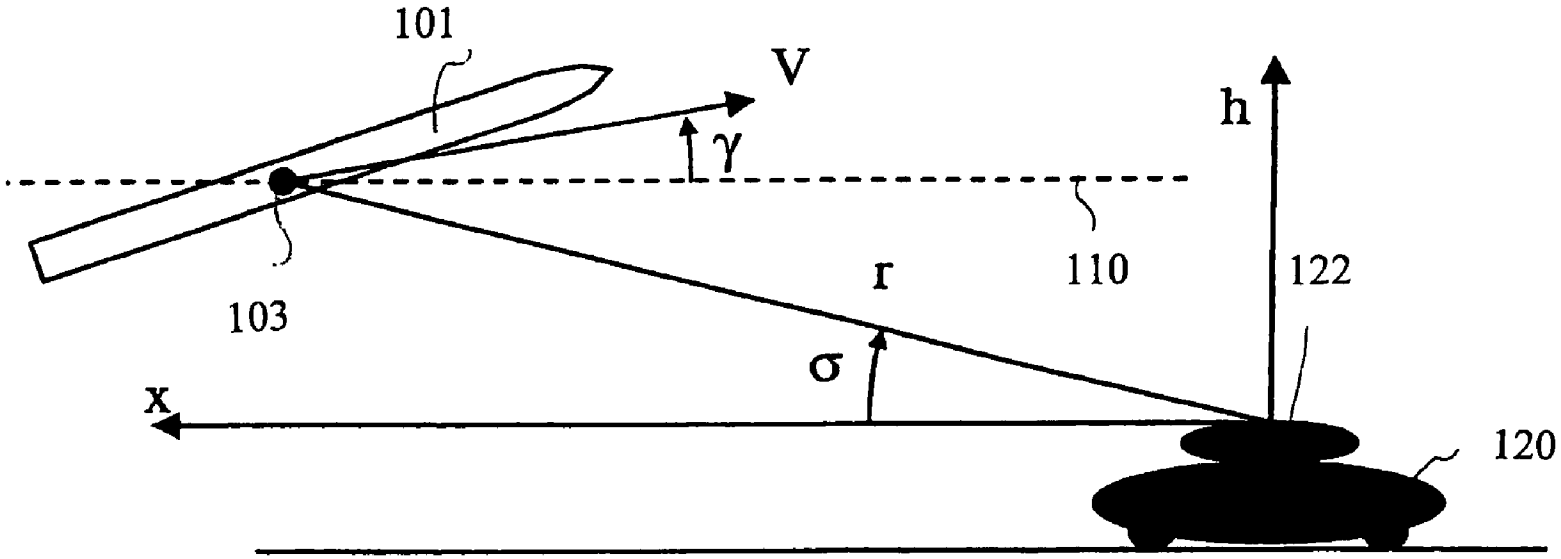
FIG. 1 is a schematic illustration defining directions, distances and angles of a missile guidance system according to a preferred embodiment of the invention.

FIG. 1 shows a schematic illustration defining directions, distances and angles according to a preferred embodiment of the present invention. An antitank missile 101 is travelling with a velocity V. The velocity vector forms a vertical flight direction angle $\gamma$ with the horizontal plane 110. The antitank missile 101 has a centre of gravity 103. A target total distance r between the centre of gravity 103 of the missile 101 represents the line of sight between said centre of gravity and a top surface 122 of a target 120. The target distance r forms an elevation angle $\sigma$ with a horizontal x-axis. A target vertical distance from the centre of gravity 103 of the missile 101 to the top surface 122 of the target 120 is designated h.

As can be derived from FIG. 1, the travelling path of the missile aims such that if all parameters are left unchanged, the missile would pass over the target at a target vertical distance h, where h can be estimated from the following formula $$h=r(\sin(\sigma)+\cos(\sigma)(\sin(\gamma))) \quad (1)$$

Assuming the target total distance r is greater than the target vertical distance h, the target vertical distance h can be approximated with the formula $$h'=r(\sigma+\gamma) \quad (2)$$

where h' designates an estimated target vertical passing distance, here also called estimated passage height. The time derivative of the elevation angle $\sigma$, also called the line-of-sight-rotation $\sigma$, fulfils the equation $$r\dot{\sigma}=V\sin(\gamma+\sigma) \quad (3)$$

Using the equation (3) to solve the total (missile to) target distance r from the height expression (2) and utilising again that the elevation angle $\sigma$ and the vertical flight direction angle $\gamma$ are small, you arrive at:

$$h' = \frac{V(\gamma+\sigma)^2}{\dot{\sigma}} \quad (4)$$

Assuming a straight flight path of the missile, the estimated passage height h' and the vertical flight direction angle $\gamma$ will be constant, even though the velocity V, the elevation angle $\sigma$ and the line-of-sight-rotation $\dot{\sigma}$ may vary. From the expression (4) above, the inventors have chosen to form a reference value for the vertical flight direction angle $\gamma$ according to the following expression $$\gamma_{ref} = \sqrt{\frac{h_{des}\dot{\sigma}}{V}} - \sigma \tag{5}$$

where "$h_{des}$" designates the desired passage height. This expression (5) will be referred to as "the law of guidance" in the following.

In order for the law of guidance to function properly, it is necessary to first check if the desired passage height $h_{des}$ and the line-of-sight-rotation $\dot{\sigma}$ have the same sign. This since it is necessary to have a positive expression under the square root sign. If the signs are different, it is advisable to steer the missile such that the vertical flight direction angle $\gamma$ becomes positive for desired passage heights $h_{des}$ greater than zero, and such that the vertical flight direction angle $\gamma$ becomes negative for desired passage heights $h_{des}$ less than zero.

The missile 101 is provided with an inertial navigation system. The missile 101 is also provided with a target seeking system. The target seeking system could be any type of present or future passive or active target seeking systems based on, but not restricted to, one or more of the following principles: laser, infra-red, radio, radar, heat and/or optical. With the aid of the target seeking system information about the direction, or the direction and the distance to the target 120, a method and a system according to an embodiment of the present invention easily calculates the necessary values of the elevation $\sigma$ and the line-of-sight rotation $\dot{\sigma}$.

Simulations have shown that the law of guidance (5) works best when the total target distance r is greater than approximately ten times the desired passage height $h_{des}$. One of the advantages with the law of guidance (5) is that when the missile is set for the correct desired passage height $h_{des}$, the reference value of the vertical flight direction angle $\gamma_{ref}$ will be constant, despite variations in the velocity V, the elevation angle $\sigma$ and the line-of-sight rotation $\dot{\sigma}$, i.e. corrections of the vertical flight direction angle $\gamma$ will be minimised.

The law of guidance (5) works less good according to performed simulations when the distance r is less than ten times the desired passage height. In practice this is not a problem since during the time left there is no time to perform any manoeuvre.

Figure 2A:
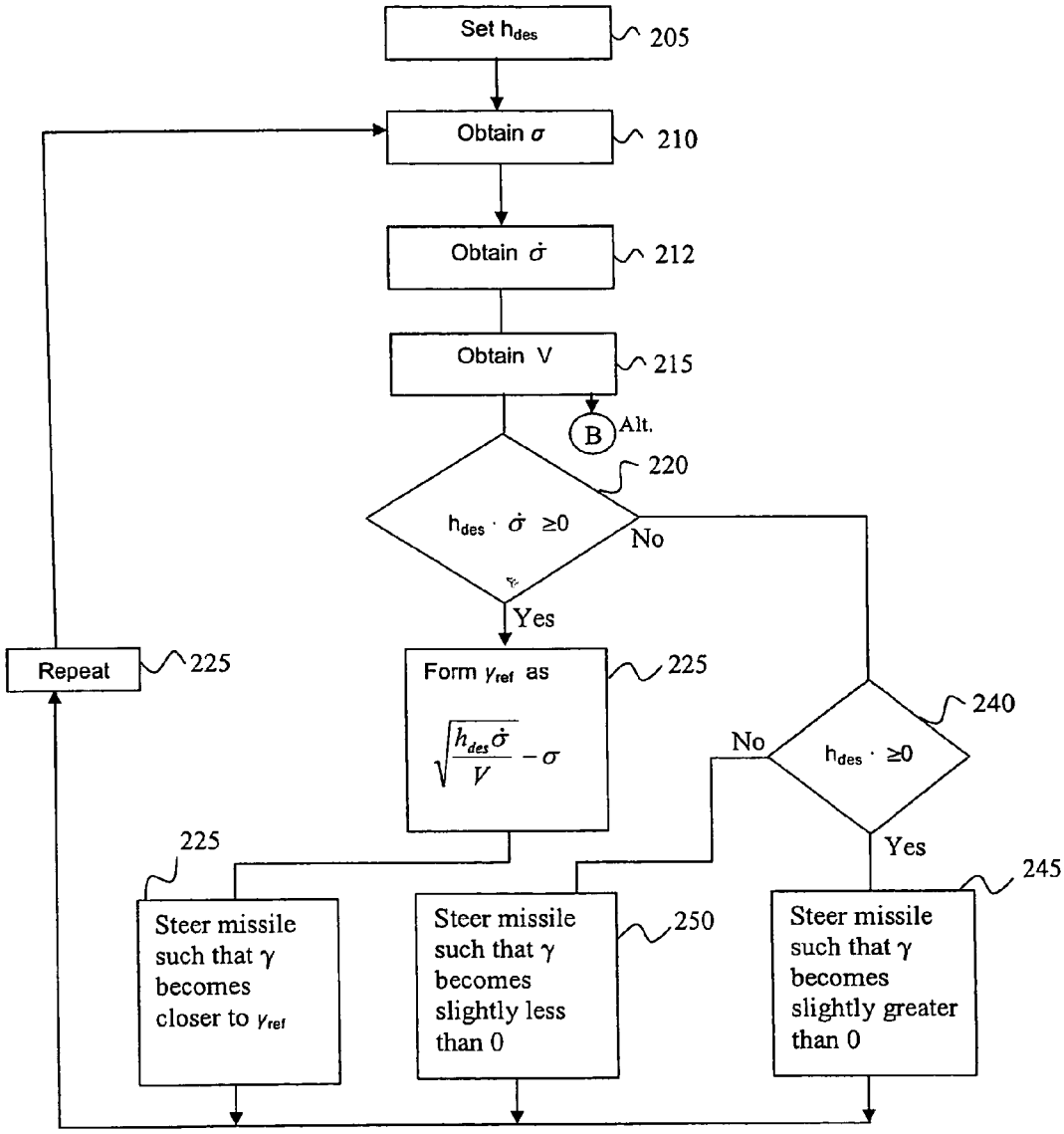
FIGS. 2A and 2B is a flowchart of a method of a missile guidance systems according to a preferred embodiment of the invention.

FIG. 2A is a flowchart of a method of a missile guidance system according to a preferred embodiment of the present invention. Said method comprises the following steps:

Setting a desired passage height $h_{des}$, 205.

Obtaining value of current elevation angle $\sigma$, 210.

Obtaining value of current line-of-sight rotation $\dot{\sigma}$, 212.

Obtaining value of current velocity V, 215.

Forming a reference value of the vertical flight direction angle $\gamma_{ref}$ as a function of desired passage height $h_{des}$, line-of-sight rotation $\dot{\sigma}$, velocity V and elevation angle $\sigma$, 225.

Steering the missile such that the vertical flight direction angle $\gamma$ becomes closer to said reference angle $\gamma_{ref}$, 230.

For the method to be efficient, the inventors have realised that the case when the desired passage height and the line-of-sight rotation have different signs, has to be handled separately. In one embodiment this comprises the following step:

Checking if the desired passage height $h_{des}$ and the line-of-sight rotation $\dot{\sigma}$ have the same sign, 220, and if so, performing the following steps:

Checking if the desired height $h_{des}$ is positive or negative, 240.

If positive, steering the missile such that the vertical flight direction angle $\gamma$ becomes slightly greater than zero, 245.

If negative, steering the missile such that the vertical flight direction angle $\gamma$ becomes slightly less than zero, 250.

Figure 2B:
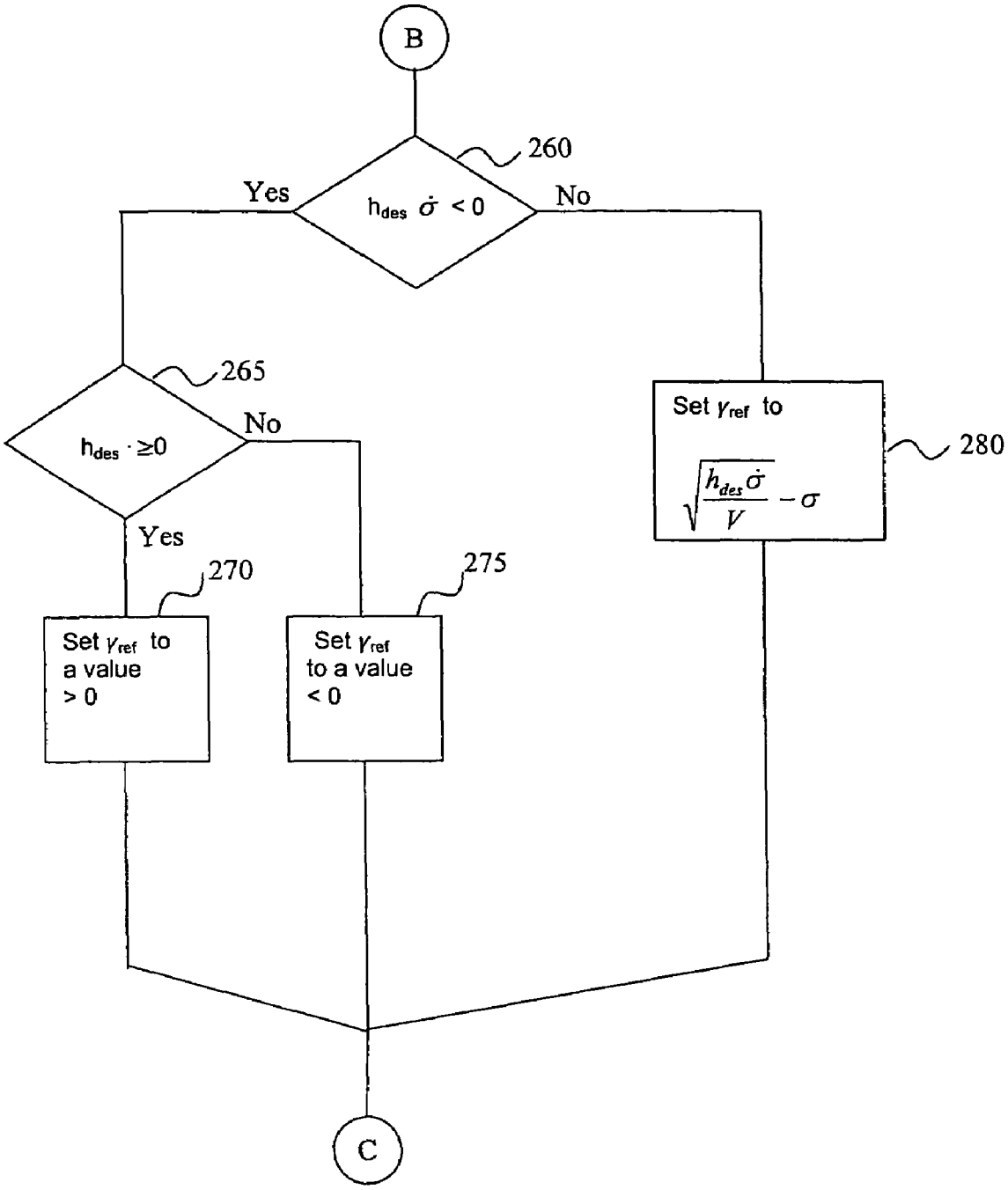

FIG. 2B is a flowchart of part of an alternative preferred embodiment of the present invention. As described above, the case where the desired height $h_{des}$ and the line-of-sight rotation $\dot{\sigma}$ have different signs is handled separately. This case is handled in a method of a further embodiment of the present invention comprising the following steps:

Checking if the desired passage height and the line-of-sight rotation have the same sign, 260.

If they have, setting the reference value of the vertical flight direction angle $\gamma_{ref}$ to a value being a function of the desired passage height $h_{des}$, the line-of-sight rotation $\dot{\sigma}$, the velocity V and the elevation angle $\sigma$, 210.

If said variable does not have the same sign, and the desired passage height $h_{des}$ is greater or equal to zero, setting the reference value of the vertical flight direction angle to a value greater than zero, 270.

If said variable does not have the same sign, and the desired passage height $h_{des}$ is less than zero, setting the reference value of the vertical flight direction angle to a value less than zero, 275.

As can be seen from the above, the function for determining the reference value of the vertical flight direction angle $\gamma_{ref}$ comprises the following variables: the desired passage height $h_{des}$, the line-of-sight rotation $\dot{\sigma}$, the velocity V and the elevation angle $\alpha$. In one embodiment, the reference value of the vertical flight direction angle $\gamma_{ref}$ is formed as, or derived from, the difference between the square root of the desired height $h_{des}$ multiplied with the line-of-sight rotation $\dot{\sigma}$ divided by the velocity V and the elevation angle $\sigma$.

Figure 3:
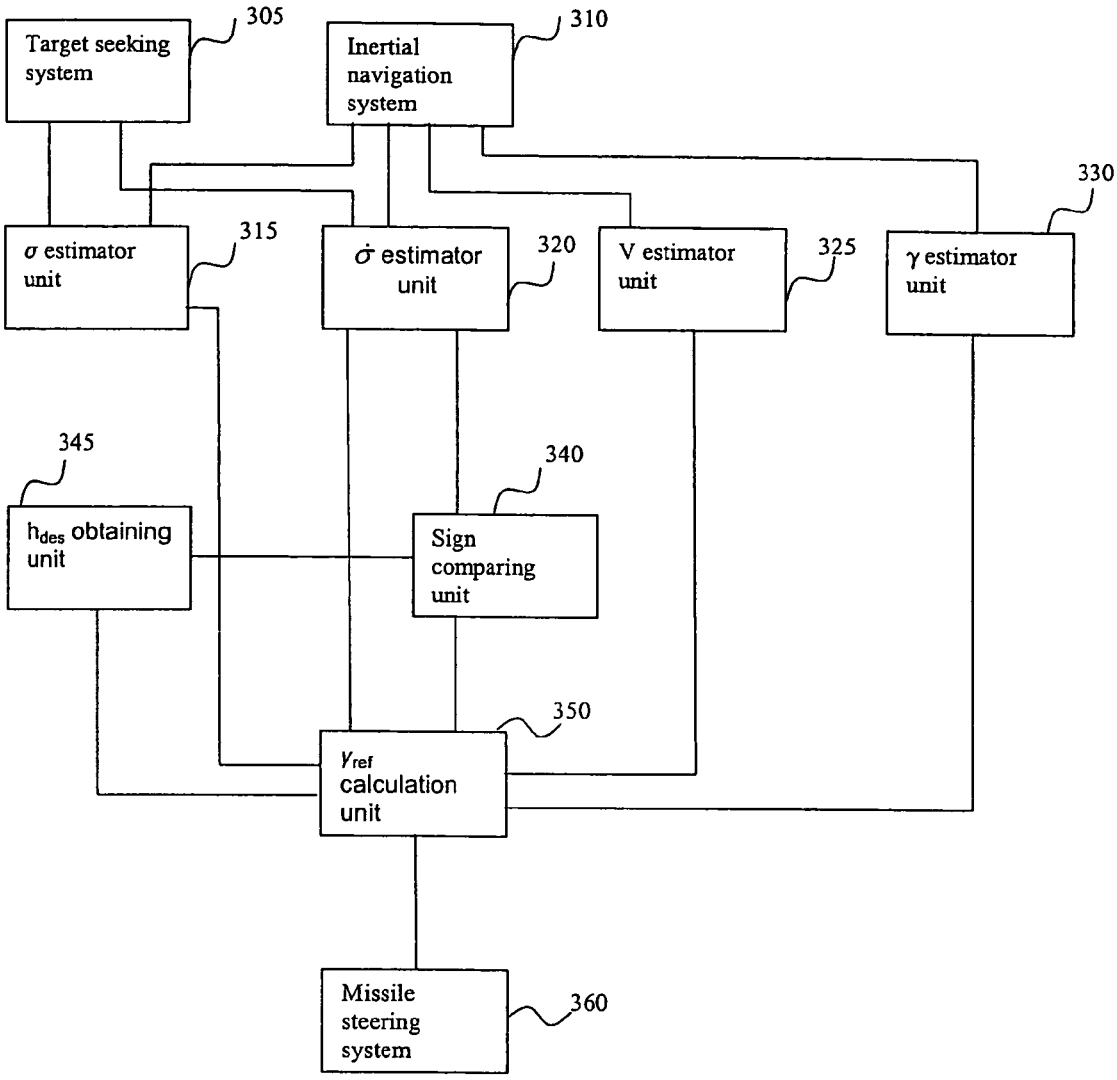
FIG. 3 shows a system overview of a missile guidance system according to a preferred embodiment of the invention.

FIG. 3 shows a system overview of a missile guidance system according to a preferred embodiment of the invention.

A target seeking system 305 is connected to an elevation angle $\sigma$ estimator unit 315. Said target seeking system 305 is also connected to a line-of-sight rotation $\dot{\sigma}$ estimator unit 320.

An inertial navigation system 310 is connected to said elevation angle $\sigma$ estimator unit 315, to said line-of-sight rotation estimator unit 320, and also to a velocity V estimator unit 325, and a vertical flight direction angle $\gamma$ estimator unit 330. The inertial navigation system 310, the target seeking system 305, and the missile steering system 360 should be viewed at as conventional ditos. The navigation system 310 is preferably of a strapped-down type as explained in e.g. D. H. Titterton and J. L. Weston "Strapdown inertial navigation technology" ISBN 0 86341 260 2. The estimator units 315, 320, 325, 330 may also be part of the target seeking system 305 or the inertial navigation system depending on selected level of integration.

Said elevation angle estimator unit 315 is further connected to a gamma-ref calculation unit 350.

Said line-of-sight rotation estimator unit 320 is connected to a sign comparing unit 340, and also to said gamma-ref calculation unit 350.

Said velocity estimator unit 325 is further connected to said gamma-ref calculation unit 350.

Said vertical flight direction angle estimator unit 330 is further connected to a missile steering system 360.

Said sign comparing unit 340 is connected to a desired passage height obtaining unit 345, and to the gamma-ref calculation unit 350.

Said gamma-ref calculation unit 350 is further connected to the missile steering system 360.

The target seeking system 305 measures the direction to the target and provides values representative of this direction to the elevation angle estimator unit 315, and to the line-of-sight estimator unit 320. The elevation angle estimator unit 315 receives values from the target seeking system representative of the direction to the target. Said elevation angle estimator unit makes an estimate of the current elevation angle $\sigma$ based on the values from the target seeking system and values from the inertial navigation system 310, representative of the missiles own flight parameters, such as altitude angles and translational and rotational velocities.

The line-of-sight rotation estimator unit 320 estimates in a similar way the line-of-sight rotation $\dot{\sigma}$ based on values from the target seeking system 305 and the inertial navigation system 310. The velocity estimator unit 325 estimates the velocity based on values from the inertial navigation system 310, representative of the velocity V.

In an alternative embodiment, the velocity estimator unit 325 is also connected to the target seeking system 305, and the velocity is estimated based on both values from the inertial navigation system 310 and from the target seeking system 305.

The gamma estimator unit 330 receives values from the inertial navigation system and estimates a vertical flight direction angle $\gamma$. Said gamma estimator unit 330 communicates said estimated vertical flight direction angle $\gamma$ to the missile steering system 360.

The desired height obtaining unit 345 obtains the desired height. Said obtaining can be effected by manual setting or automatic setting by a computer program, or another suitable method. The value representing the desired passing height $h_{des}$ is communicated to the sign comparing unit. The sign comparing unit 340 compares the signs of the designated passage height and the line-of-sight rotation $\dot{\sigma}$. The result is communicated to the gamma-ref calculation unit 350, which calculates a reference value for the vertical flight direction angle $\gamma_{ref}$ according to the method explained above. The reference value $\gamma_{ref}$ is then communicated to the missile steering system 360, which makes the necessary adjustments of the missile ailerons, control surfaces, or other means for adjusting the course of the missile to get the vertical flight direction angle $\gamma$ closer to the reference value $\gamma_{ref}$. Such course changes are obtained in one embodiment by steering in vertical direction according to the following expression:

$$a_c = K(\gamma_{ref} - \gamma) \tag{6}$$

where $a_c$ is the commanded acceleration and K is a constant. $\gamma_{ref}$ and $\gamma$ as explained above.

In a further embodiment such course changes are obtained by steering in vertical direction according to the following expression:

$$a_c = CV_c \frac{d}{dt}(\gamma_{ref}) \tag{7}$$

where C is another constant and $V_c$ is the commanded velocity.

It is understood the missile guidance system also comprises a horizontal guidance function. This is however not part of the invention and is not described here.

The scope of the invention is only limited by the claims below.

The invention claimed is:

1. A missile, comprising:

a propulsion system;

a target seeking system;

an inertial navigation system;

a missile steering system to adjust a vertical flight direction angle (y) of said missile in flight; and a missile guidance system connected to said target seeking system, to guide said missile, based on information from said target seeking system, to pass a predetermined distance ($h_{des}$) above a target.

2. The missile according to claim 1, wherein said missile guidance system comprises a gamma-ref calculation unit to calculate a reference value of a vertical flight direction angle ($\gamma_{ref}$) used to adjust a current vertical flight direction angle ($\gamma$) of the missile to cause the missile to pass the target at a desired passage height ($h_{des}$).

3. The missile according to claim 2, wherein said gamma-ref calculation unit calculates the reference value of the vertical flight direction angle ($\gamma_{ref}$) based on the following parameters:

an elevation angle ($\sigma$), a desired passage height ($h_{des}$), a line-of-sight rotation ($\dot{\sigma}$), and a missile velocity (V).

4. The missile according to claim 3, wherein said parameters are used to calculate the reference value of the vertical flight direction angle ($\gamma_{ref}$) according to the following expression $$\gamma_{ref} = \sqrt{\frac{h_{des}\dot{\sigma}}{V}} - \sigma. \tag{5}$$

5. A missile guidance system for use in a missile, wherein said system is to guide said missile to pass a predetermined distance ($h_{des}$) above a target, the system comprising:

a gamma-ref calculation unit to calculate a reference value of a vertical flight direction angle ($\gamma_{ref}$) used to adjust a current vertical flight direction angle ($\gamma$) of said missile to cause the missile to pass the target at a desired passage height ($h_{des}$); and a missile steering system configured to adjust the current vertical flight direction angle ($\gamma$) of said missile to cause the missile to pass the target at a desired passage height ($h_{des}$).

6. The system according to claim 5, wherein said gamma-ref calculation unit calculates the reference value of the vertical flight direction angle ($\gamma_{ref}$) based on the following parameters:

an elevation angle ($\sigma$), a desired passage height ($h_{des}$), a line-of-sight rotation ($\dot{\sigma}$), and a missile velocity (V).

7. The system according to claim 6, wherein said parameters are used to calculate the reference value of the vertical flight direction angle ($\gamma_{ref}$) according to the following expression $$\gamma_{ref} = \sqrt{\frac{h_{des}\dot{\sigma}}{V}} - \sigma. \tag{5}$$

8. A method for guiding a missile towards a target, the method comprising:

setting a desired passage height ($h_{des}$);

obtaining a value of current line-of-sight rotation ($\dot{\sigma}$);

obtaining a value of current velocity (V);

forming a reference value for a vertical flight direction angle ($\gamma_{ref}$) as a function of desired passage height ($h_{des}$), line-of-sight rotation ($\dot{\sigma}$), velocity (V) and elevation angle ($\sigma$); and steering the missile such that the vertical flight direction angle (y) becomes closer to said reference angle ($\gamma_{ref}$).

9. The method according to claim 8, wherein said forming a reference value for the vertical flight direction angle ($\gamma_{ref}$) comprises use of the expression $$\gamma_{ref} = \sqrt{\frac{h_{des}\dot{\sigma}}{V}} - \sigma. \tag{5}$$

* * * * *